United States Patent [19]

Heuberger et al.

[11] Patent Number: 4,890,772

[45] Date of Patent: Jan. 2, 1990

[54] TRANSPORT AND STORAGE CONTAINER FOR CONCENTRATES OF BEVERAGES OR THE LIKE

[75] Inventors: Erich Heuberger, Trugenhofen; Wolf-Dieter Knörrich; Joachim W. Dziallas, both of Heidenheim, all of Fed. Rep. of Germany

[73] Assignees: Carl Edelmann Verpackungstechnik, Heidenheim/Brenz, Fed. Rep. of Germany; Coca Cola Company, Atlanta, Ga.

[21] Appl. No.: 121,636

[22] Filed: Nov. 13, 1987

Related U.S. Application Data

[63] Continuation-in-part of Ser. No. 932,294, Nov. 19, 1986, abandoned.

[30] Foreign Application Priority Data

Nov. 19, 1985 [DE] Fed. Rep. of Germany ..... 3541010
Jul. 28, 1987 [EP] European Pat. Off. ..... 87110947.6

[51] Int. Cl.[4] ..... B67D 5/38

[52] U.S. Cl. ..... 222/156; 222/183; 222/185; 222/325; 222/460; 222/107; 220/462

[58] Field of Search ..... 220/462; 222/105, 183, 222/185, 154, 156, 325, 460, 462, 107

[56] References Cited

U.S. PATENT DOCUMENTS

| | | | |
|---|---|---|---|
| 3,295,725 | 1/1967 | Brandt | 222/107 |
| 3,363,822 | 1/1968 | Maulini et al. | 220/462 |
| 3,559,847 | 2/1971 | Goodrich | 222/107 |
| 3,756,471 | 9/1973 | Wissman | 222/156 |
| 3,837,533 | 9/1974 | Splan | 222/105 |
| 4,526,823 | 7/1985 | Farrell et al. | 222/107 |
| 4,560,090 | 12/1985 | Okushita | 222/105 |

*Primary Examiner*—H. Grant Skaggs
*Attorney, Agent, or Firm*—Nies, Webner, Kurz & Bergert

[57] ABSTRACT

A transport and storage container for concentrates of beverages or the like for making a ready-to-drink beverage by means of a drink-making machine is provided in the form of an inner bag package, whereof the two narrow side walls, as well as the top and bottom, are parallel to each other, whereof the narrow side wall containing the concentrate outlet, removal and connection, piece and the opposite narrow side wall form angles of approximately 93° and 87° with the top and with the bottom. The two triangular wall portions of the inner bag gussets located in the bottom and top planes of the package are sealed or welded together, and a viewing window structure is provided in the outer cardboard casing of the package adjacent the end where the concentrate outlet piece is located.

10 Claims, 2 Drawing Sheets

TRANSPORT AND STORAGE CONTAINER FOR CONCENTRATES OF BEVERAGES OR THE LIKE

RELATED APPLICATION

This application is a continuation-in-part of application Ser. No. 932,294 filed November 19, 1986, now abandoned.

BACKGROUND OF THE INVENTION

This invention refers to a transport and storage container for concentrates of beverages or the like, particularly such as fruit juice syrups or the like, for making a ready-to-drink beverage, which container is capable of being inserted into a drink-making machine and connected to its system, wherein a dose of concentrate is removed from the supply of concentrate and water and, if applicable, carbon dioxide are added. The container consists of what is called an inner bag package known per se with an outer cardboard casing in the form of a folding box. The box has interconnected, especially glued together bottom and top flaps and a liquid-tight inner bas closed at its upper and lower ends by a sealed or welded seam, and wherein the inner bag gussets are folded inwardly in the area of the bottom and top closures and lie between two bottom or top flaps each. The bottom and top closures both of the inner bag and of the cardboard casing are identically embodied, the removal and machine-connection piece is connected by a flange to a side wall of the inner bag and the connection piece projects outwardly through an orifice in the side wall of the cardboard casing.

Up to now, plastic containers have been used for the transport, storage and keeping of beverage concentrates and the provision of supplies thereof in drink-making machines, which containers are insertedinto these machines and connected to the concentrate removal system of the machine. A disadvantage of the previously known plastic containers consists in the fact that upon their being "emptied" a relatively large, no longer usable residual quantity of concentrate remains in them. Furthermore, only certain plastics, unharmful to foodstuffs and luxury foods, can be used for the manufacture of the containers. However, this has the disadvantage of not being optimal with regard to some beverage concentrates, since, if longer storage times are involved, they can detract from the tast of the container contents. Also, the disposal of the empty plastic containers results in a considerable burden on the environment.

The already mentioned transport and storage containers consisting of inner bag packages have already been proposed for the purpose in question; however, the forms and designs available up to now have not yet proven to be satisfactoy enough to enable their unreserved practical use.

OBJECT OF THE INVENTION

The invention is therefore based on the task of improving the containers in question for beverage concentrates, insertable in drink-making machines, in such a way that on being emptied, only a very minimum residual amount effectively remains, and in which it should be possible to check the level of the contents of the container inserted in the drink-making machines without the stability of the package or its contents being diminished by a viewing window making this possible.

Finally, any detraction from taste of the container contents is also to be avoided.

For the solution of this task, according to the invention it is suggested that the container of the given type be embodied in such a way that the two triangular wall portions of the inner bag gussets located in the bottom and top planes of the package are sealed or welded together, the two narrow side walls, like the top and the bottom of the package, are in parallel arrangement to each other, but the narrower side wall containing the removal and connection piece and the opposite side wall respectfully form angles of approximately 93° and 87° with the bottom surface and of approximately 87° and 93° with the top surface.

Inner bag packages of the designated type have become known in the widest variety of forms. A considerable disadvantage existing in such packages if they are used as transport and storage containers for beverage concentrates for use in drink-making machines is that a considerable residual amount of the liquid contained therein remains in the container, since the inner bag generally does not flatly abut the inner wall of the cardboard casing surrounding it, but rather forms creases, recesses or similar uneven places which hinder a desired flow-off of the contents of the container. Thus a certain, albeit only a seemingly relatively small quantity of the contents is lost to the consumer with each package. However, such lost quantities, added up over a longer period of time, are indeed of substantial significance.

If, however, instead of beverage concentrates environmentally harmful chemicals in concentrated form are involved, for instance such as those used for pest control or plant protection and the like, then the residual amounts left in the emptied packages have particularly serious consequences. Therefore, strong demands for packaging such substances only in such a way that they can be removed from the packages with virtually no residue have recently been made. Thus the packages proposed according to the invention are also usable in the last-above-mentioned technical field.

The novel features serving to solve the problem or to promote and further develop the solution will become apparent from the appended claims as well as in the following detailed description of embodiments of a package designed in accordance with the invention, as represented by FIGS. 1 to 5 of the drawings.

DETAILED DESCRIPTION OF THE DRAWINGS

Figure 2:
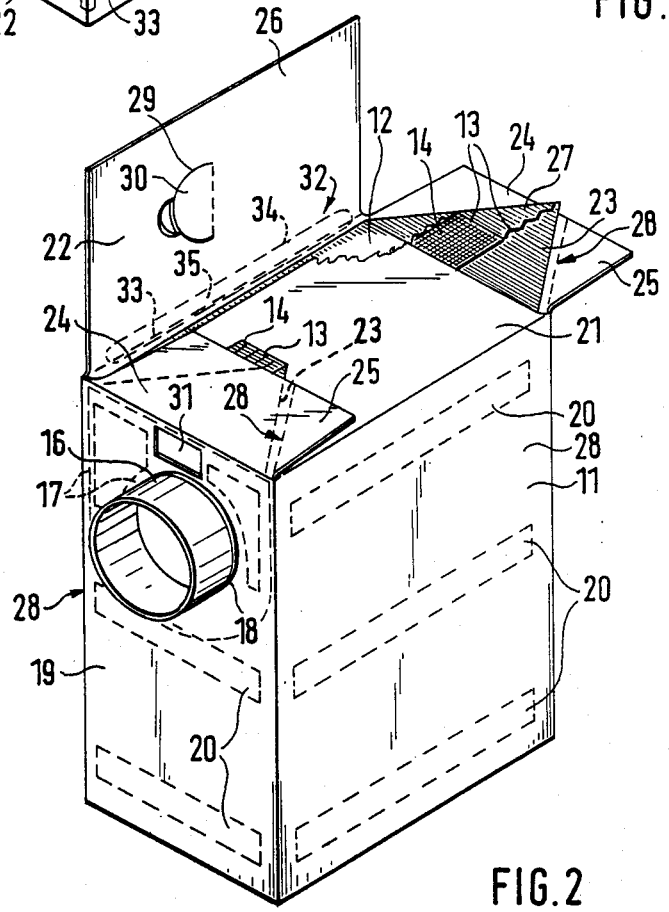
FIG. 2 shows a perspective view of the only partly closed, not yet filled, package with inner bag according to FIG. 1.

As seen in particular in FIG. 2, the package comprises as usual, in this type of package, the outer cardboard casing 11 and the inner bag 12 consisting of a composite foil which can be a thin foil laminate, e.g., a three layer laminate of foils of plastic, aluminum, plastic, or of three foil laminates of transparent plastic, the middle layer being a gas-tight transparent plastic foil.

The packages of the type in question are usually supplied lying flatly to the consumer and are to be set up and filled by machine only before being used. The inner bag 12 is closed by sealing or welding first at its lower end and then at its upper end by means of a transverse seam 13. The bottom of the cardboard casing is shown already closed, namely in the same way as the top closure. At its upper end the package is shown still partly open.

Figure 1:
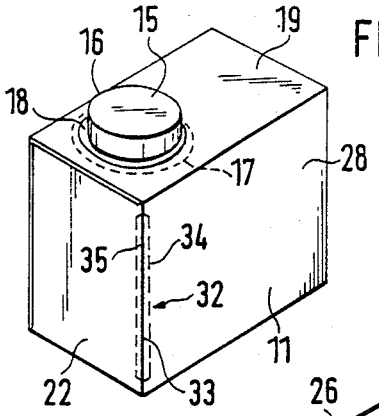
FIG. 1 shows a perspective view of the finished package with closed inner bag in its filled position.

Before the inner bag end is sealed and closed, the filling and outlet connection piece 16, to be later provided with a sealed cap 15 (FIG. 1), is securely connected and sealed to the inner bag 12 so as to be liquid-tight by means of a flange 17. The connection piece 16 has a tubular member which projects from within the bag 12 to the outside of the package through an orifice 18 in the one narrow side wall 19 of the cardboard casing 11.

Figure 4:
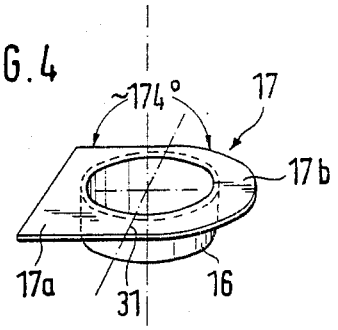
FIG. 4 shows a perspective view of the filling and outlet connection piece with its flange.
Figure 5:
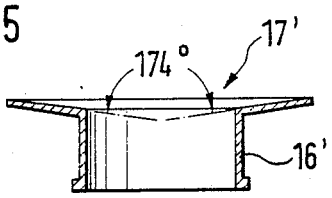
FIG. 5 shows a section through the outlet connection piece in a second embodiment.

The filling and outlet connection piece 16 with its flange 17 can be seen especially in FIG. 4. The flange 17 is designed to have a relatively large area and is shaped such that three of the edges lying at right angles to each other abut the adjacent walls of the interior of the bag 12. The flange 17 has a bend 31 which approximately intersects the axis of the outlet connection piece 16. The angle formed by the two flange parts 17*a* and 17*b* is preferably 174°. However, it is also possible to design the flange 17 as a whole in the form of a very flat funnel 17', with the funnel angle likewise being approximately 174°, as seen in FIG. 5. In this way it is possible for the container contents to pour into the tubular outlet piece and out of the package and to be used almost completely.

The inner bag 12 is advantageously glued at several locations, including adjacent its upper and lower ends to the inner side of the cardboard casing 11 in the area of the surfaces 20 marked by dotted lines, to guarantee that the bag securely abuts and is adhered to the inner wall of the cardboard casing of the package and to prevent the inner bag 12 from collapsing with progressive emptying.

To achieve the required, necessarily very substantial stability of form, the inner bag 12 is held or clamped fast in the area of the top and bottom by the special design of the top and bottom closure, whereby a particularly stable construction results in the area of the top and bottom.

Although, for the sake of simplicity, the following description refers to the design of the package in the area of the top opening or its closure, this applies to the design of the bottom closure accordingly.

The size of the two larger top and bottom flaps 21, 22 of the cardboard casing facing each other before closure substantially corresponds to that of the top and bottom openings of the package.

In closing the package, first of all, the inner bag 12 is closed by means of the liquid-tight welded or sealed seam 13 and then the edge 14 containing this seam is folded onto the plane of the top opening of the cardboard casing 11, whereupon the superposed wall portions of the lateral gussets 23 are sealed or welded together. In this way, the gussets are sealed from the main interior part of the bag 12 and liquid which could otherwise remain as a residual amount in an emptied package is prevented from entering the gussets 23. Furthermore, this measure will provide an additional stiffening of the package in the bottom and top areas. The lateral gussets 23 are laid outwardly onto the outwardly turned smaller top flaps 24, as seen at the upper right-hand portion of FIG. 2, and are preferably glued thereto. The lowest or innermost top flap 21 is folded against the upper end of the inner bag 12 and subsequently the smaller top flaps 24 with the gussets 23 of the inner bag 12 are folded against the larger top flap 21 lying on the inner bag 12 and are glued thereto. Finally, the upper or outer top flap 22 is folded down and glued to the top surfaces of flaps 21 and 24 which are alrady closing the top opening.

To produce as good and secure a connection as possible between the upper or outer top flap 22 and the lower or inner top flap 21 by gluing, the corners 25 of the smaller top flaps 24 are cut off, so that the free edge 26 of the upper top flap 22 can be glued virtually along its entire length to the top flap 21.

To enable good and stable gluing of the smaller top flaps 24 to the lower or inner top flaps 21, the outer corners 27 of the inner bag edge 14 can be folded against the gussets 23, whereby a large gluing surface can be obtained.

Figure 3:
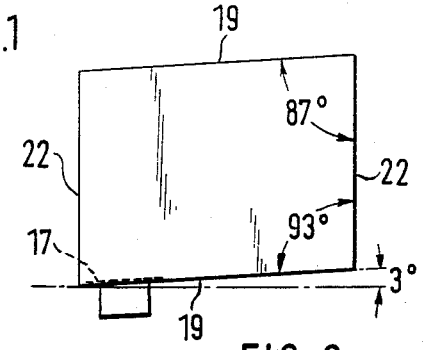
FIG. 3 shows a side view of the package according to FIG. 1 in a position assumed upon being inserted in a drinkmaking machine.

As seen in FIG. 3 in particular, the narrow side walls 19 are not at right angles to the vertical top or bottom flap 22, but are rather at an angle of approximately 87° at one end and 93° at the other end, so that after insertion of the package into a drink-making machine with the ends represented by flaps 22 being held vertical, the narrow side wall 19, with the removal or outlet connection piece 16, which is now the bottom wall is downwardly inclined by approximately 3° toward said connection piece relative to a horizontal H. In this way the residual container contents must necessarily run into the outlet connection piece 16. This is also promoted by the design of the flange 17 and 17' of the outlet connection piece 16 and 16' according to FIG. 4 and FIG. 5.

In order to check the level of the liquid contained in the interior of the container, it is advantageous to provide a viewing window 32 enabling this, which, however, requires that the inner bag 12 of the container be made of a transparent foil. As seen in FIG. 2, the viewing window 32 is arranged in the area of the edge 33 between the one side wall 28 and the top flap 22. In order not to diminish the stability of the package prior to its insertion into a drink-making machine, a perforated line 34 is located in the side wall 28 and in the top 22 along the edges of the viewing window 32, so that the cardboard strip 35 bordered by the perforated line need only be removed from the cardboard casing 11 to form the viewing window 32 at a suitable point in time. This construction also has the advantage of protecting the contents from the effects of light.

If desired, as an alternate location, a viewing window 31 can be provided in the outer cardboard casing near the outlet piece 16, at the adjacent edge of the side wall 19, as also shown in FIG. 2 and as is true with the construction of viewing window 32, the inner bag 12 in this case must also be made of a transparent material.

It is advantageous to locate a slot 29 extending around three-quarters of a circle in the top flap 22, thus forming a tab 30 with the aid of which the package can be more easily pulled from a stack or from the shaft of the drink-making machine into which the package has been inserted.

The packages designed in accordance with the invention also have the advantage of being capable of bearing substantial loads, especially while forming stacks of packages, due to their great stability of form. In these cases the packages are turned by 90°, whereby the bottoms and tops become side walls.

The existing dispenser machines into which the container is inserted has a fixed depth. Prior art containers for the dispensers have been rectangular and dimensioned for the depth of the dispenser machine. The skewed parallelogram shape of the container of this invention results in a package that has the same depth between its ends so it fits into the existing dispenser machines with front and rear walls vertical and the lower wall inclined toward the outlet connection piece. The shape of the container of this invention provides a greater capacity than a rectangular container which has the same end wall area and the same depth dimension as that measured between the walls 22 of the container of this invention.

The invention may be embodied in other specific forms without departing from the spirit or essential characteristics thereof. The present embodiments are therefore to be considered in all respects as illustrative and not restrictive, the scope of the invention being indicated by the appended claims rather than bu the foregoing description, and all changes which come within the meaning and range of equivalency of the the claims are therefore intended to be embraced therein.

What is claimed is:

1. An improved transport and storage container for concentrates of beverages or the like, for making a ready-to-drink beverage, said container being insertable into a drink-making machine and connectable to its system, wherein a dose of concentrate from the container, a dose of water and, if applicable, carbon dioxide are added; said container consisting of an inner bag package with two narrow side walls and two wide side walls with a folding box type outer cardboard casing (11) having a top and bottom end and two narrow side walls (19) interconnected with two wide side walls (28) each wide side wall (28) of the casing, having integral top and bottom flaps (21, 22) folded toward and overlapped with each other and each narrow side wall (19), of the casing, having integral top and bottom flaps (24) folded toward each other, the folded wide side wall top flaps (21, 22) sandwiching the folded narrow side wall top flaps (24), the folded wide side wall bottom flaps sandwiching the folded narrow side wall bottom flaps, and the sandwiched flaps at each end being glued together and respectively constituting top and bottom end closures of the cardboard casing; the inner bag package comprising a liquid-tight inner bag (12) closed at both of its upper and lower ends by a transverse sealed weld seam (13), each said end weld seam and the adjacent parts of the inner bag ends being folded to provide two triangular corner gussets (23) at each of the top and bottom ends and said inner bag corner gussets (23) being folded inwardly in the area of the bottom and top closures and disposed to lie between respective associated two bottom casing flaps and two top casing flaps (21, 22, 24), the sides and the bottom and the top end closures, both of the inner bag (12) and of the cardboard casing (11), forming essentially identically shaped enclosures; the side walls and ends of the bag having interior surfaces; a concentrate removal and machine-connection piece (16), with an inlet and outlet, is provided and includes a flange (17) sealed and connected to a narrow side wall inner surface of and adjacent the top end of the inner bag (12), and an inner bag narrow side wall and the adjacent cardboard casing narrow side wall (19) having aligned orifices adjacent one end of the container; said connection piece (16) having a short tubular portion between said inlet and said outlet which projects outwardly through said orifices, the improved inner bag package being constructed with the two triangular wall portions of each of the inner bag triangular gussets (23), located in the bottom and top planes of the package, sealed together by welding, the two narrow side walls (19) as well as the top and bottom surfaces (22) of the container are respectively parallel to each other, and with the narrow side wall (19), containing the removal and connection piece (16), and the opposite narrow side wall being connected to the upper and lower casing ends to form angles of respectively aproximately 93° and 87° with the casing bottom end surface and angles of respectively approximately 87° and 93° with the casing top end surface.

2. A container according to claim 1, characterized in that the flange (17) of the removal and connection piece (16), connected to the interior of the inner bag (12), extends to the three interior surfaces of adjacent wide inner bag side walls and the adjacent top inner bag surface.

3. A container according to claim 2, characterized in that the flange (17) of the removal and connection piece (16) has a bend line (31) crossing the inlet opening, and the flange parts (17*a*, 17*b*) on both sides of the bend (31) form an angle of approximately 174°.

4. A container according to claim 1 characterized in that the flange (17) of the removal and connection piece (16) is in the shape of a very shallow frusta-conical funnel with a funnel angle of approximately 174°.

5. A container according to claim 1, 3 or 4, characterized in that the inner bag (12) is connected to the inner side of the outer cardboard casing (11) by gluing at plural areas, such as spots or strips located at least in the area of the upper and the lower end of the package.

6. A container according to claim 1, 3 or 4, with an inner bag consisting of transparent plastic foil, in coordination with a cardboard strip (35) to be removed from the cardboard casing to form a viewing window (32) for determining the level of the container contents, said strip being enabled by a closed perforated line (34) at least partially arranged in the cardboard casing (11) in the sidewall (19) containing the removal and connection piece (16).

7. A container according to claim 6, characterized in that the inner bag (12) consists of a three-layered composite foil whereof the middle layer is a gas-tight, transparent plastic foil.

8. A container according to claim 1, 3 or 4, characterized in that the inner bag (12) consists of a three-layered composite foil whereof the middle layer is aluminum foil.

9. A container according to claim 1, 3 or 4, characterized in that the inner bag (12) consists of a three-layered composite foil whereof the middle layer is a gas-tight, transparent plastic foil.

10. A container according to claim 9, wherein a viewing window (32 or 31) is provided in the cardboard casing near the removal and connection piece (16).

* * * * *

UNITED STATES PATENT AND TRADEMARK OFFICE

CERTIFICATE OF CORRECTION

PATENT NO. : 4,890,772

DATED : January 2, 1990

INVENTOR(S) : ERICH HEUBERGER, WOLF-DIETER KNORRICH, and JOACHIM W. DZIALLAS

It is certified that error appears in the above-identified patent and that said Letters Patent is hereby corrected as shown below:

ON THE COVER SHEET:

In item [73] the names of both Assignees should be corrected to read as follows:

--CARL EDELMANN VERPACKUNGSTECHNIK GmbH--.

and

--THE COCA-COLA COMPANY--.

Column 1, line 24, "bas" should read --bag--.

, line 37, "insertedinto" should read --inserted into--.

, line 49, "tast" should read --taste--.

Signed and Sealed this

Sixteenth Day of April, 1991

*Attest:*

*Attesting Officer*

HARRY F. MANBECK, JR.

*Commissioner of Patents and Trademarks*